US009086197B2

(12) United States Patent
Audette et al.

(10) Patent No.: US 9,086,197 B2
(45) Date of Patent: Jul. 21, 2015

(54) MODULAR LED SPACE LIGHT

(75) Inventors: James Audette, Valencia, CA (US); John Audette, Burbank, CA (US); Victor Druan, Valencia, CA (US); Kelly Koskella, Valencia, CA (US)

(73) Assignees: Raleigh Enterprises, LLC, Hollywood, CA (US); Special T Lighting, Inc., San Fernando, CA (US)

( * ) Notice: Subject to any disclaimer, the term of this patent is extended or adjusted under 35 U.S.C. 154(b) by 433 days.

(21) Appl. No.: 13/347,625

(22) Filed: Jan. 10, 2012

(65) Prior Publication Data

US 2013/0176707 A1 Jul. 11, 2013

(51) Int. Cl.

| | |
|---|---|
| ***F21V 17/06*** | (2006.01) |
| ***F21S 2/00*** | (2006.01) |
| ***F21V 29/00*** | (2015.01) |
| ***F21S 8/06*** | (2006.01) |
| ***F21V 29/83*** | (2015.01) |
| *F21K 99/00* | (2010.01) |
| *F21V 9/16* | (2006.01) |
| *F21Y 101/02* | (2006.01) |
| *F21Y 105/00* | (2006.01) |
| *F21V 29/76* | (2015.01) |

(52) U.S. Cl.

CPC ..... *F21S 2/005* (2013.01); *F21S 8/061* (2013.01); *F21V 29/20* (2013.01); *F21V 29/83* (2015.01); *F21K 9/30* (2013.01); *F21V 9/16* (2013.01); *F21V 29/763* (2015.01); *F21Y 2101/02* (2013.01); *F21Y 2105/003* (2013.01)

(58) Field of Classification Search

CPC ..... F21Y 2101/02; F21Y 2105/001; F21Y 2103/003; F21Y 2111/001; F21Y 2103/022; F21Y 2111/005; F21V 29/004; F21V 29/22; F21V 29/2206; F21V 15/011; F21V 29/2293; F21V 3/00; F21V 15/01; F21V 29/00

USPC ..... 362/367, 434, 294, 373

See application file for complete search history.

(56) References Cited

U.S. PATENT DOCUMENTS

| | | | | |
|---|---|---|---|---|
| 6,948,823 | B2 | 9/2005 | Pohlert et al. | |
| 7,318,652 | B2 | 1/2008 | Pohlert et al. | |
| 7,972,022 | B2 | 7/2011 | Pohlert et al. | |
| 2004/0223315 | A1* | 11/2004 | Suehiro et al. | 362/249 |
| 2007/0285949 | A1* | 12/2007 | Lodhie et al. | 362/648 |
| 2010/0084979 | A1* | 4/2010 | Burton et al. | 362/249.02 |
| 2010/0220478 | A1* | 9/2010 | Fields et al. | 362/237 |
| 2011/0242809 | A1* | 10/2011 | Medendorp et al. | 362/235 |

OTHER PUBLICATIONS

MAC Tech LED (1 sheet).
Killer Plasma Maxi (1 sheet).

(Continued)

*Primary Examiner* — William Carter

(74) *Attorney, Agent, or Firm* — Arlyn Alonzo; Alonzo & Associates

(57) ABSTRACT

A modular light emitting diode (LED) space light including a top plate including a top plate slot; a bottom plate including a bottom plate slot; at least one module having at least one light emitting diode (LED), wherein the at least one module is adapted to fit between the top plate and the bottom plate correspondingly in the top plate slot and the bottom plate slot; and at least one passive heat sink coupled to the at least one module to dissipate heat generated by the at least one LED.

27 Claims, 12 Drawing Sheets

(56) References Cited

OTHER PUBLICATIONS

Nila SL data sheet with copyright date 2011 and additional content dated Apr. 2008 and Feb. 2010 (10 sheets).

PRG OHM Light available on the following website: www.prg.com (3 sheets).

* cited by examiner

MODULAR LED SPACE LIGHT

FIELD

This disclosure relates generally to lighting. More particularly, the disclosure relates to LED space lights.

BACKGROUND

In general, a space light is used to provide even soft light, typically in a stage environment or an indoor/outdoor setting. Space lights may also be useful in green screen/blue screen lighting, which has become more prevalent in recent years due to an increase of films being shot for 3D viewing and the advancement in camera technology.

Conventional space lights using tungsten bulbs are unreliable. And, to provide adequate lighting, their power consumption is large and they generate a large amount of heat. For example, a conventional space light such as a 6K space light may comprise six 1000 W (1K) bulbs (a.k.a. globes) This 6K space light may require 50 amps to operate. The operational lifetime of a 1K bulb is approximately 400 hours. As a result, conventional tungsten bulb space lights have a short operational lifetime, utilize a large amount of electrical energy, have heat dissipation challenges, impose large heating ventilation and air conditioning (HVAC) and high costs in locations where they are installed. And, the tungsten bulb uses halogen gas which is a corrosive and highly toxic gas and has restrictions regarding disposal thereof.

SUMMARY

The following presents a simplified summary of one or more aspects in order to provide a basic understanding of such aspects. This summary is not an extensive overview of all contemplated aspects, and is intended to neither identify key or critical elements of all aspects nor delineate the scope of any or all aspects. Its sole purpose is to present some concepts of one or more aspects in a simplified form as a prelude to the more detailed description that is presented later.

Disclosed is a modular light emitting diode (LED) space light. According to one aspect, a modular light emitting diode (LED) space light including a top plate including a top plate slot; a bottom plate including a bottom plate slot; at least one module having at least one light emitting diode (LED), wherein the at least one module is adapted to fit between the top plate and the bottom plate correspondingly in the top plate slot and the bottom plate slot; and at least one passive heat sink coupled to the at least one module to dissipate heat generated by the at least one LED.

According to another aspect, a module for inserting into a light emitting diode (LED) space light, the module including a plurality of light emitting diodes (LEDs) mounted on at least one printed circuit board (PCB); a passive heat sink; a front module plate including a top portion and a bottom portion, wherein the top portion includes ridges, wherein the ridges and the passive heat sink thermally propagate heat emitted by the plurality of LEDs.

According to yet another aspect, a modular light emitting diode (LED) space light including a top plate including at least six top plate slots; a bottom plate including at least six bottom plate slots; at least six modules with each module having at least one light emitting diode (LED), wherein each of the at least six modules is adapted to fit between the top plate and the bottom plate correspondingly in one of the at least six top plate slots and in one of the at least six bottom plate slots in a radial pattern; and at least six passive heat sinks with one of the at least six passive heat sinks coupled to one of the at least six modules to dissipate heat generated by the at least one LED mounted on the one of the at least six modules.

Possible advantages of the present disclosure may include longer operational lifetime, less power consumption, decreased heat dissipation challenges and environmental compatibility. Additional possible advantages may include use of less and/or lighter external cabling and/or power feeds in order to energize the space light, and ease of adjusting the color temperature(s) of a space light.

It is understood that other aspects will become readily apparent to those skilled in the art from the following detailed description, wherein it is shown and described various aspects by way of illustration. The drawings and detailed description are to be regarded as illustrative in nature and not as restrictive.

DETAILED DESCRIPTION

The detailed description set forth below in connection with the appended drawings is intended as a description of various aspects of the present disclosure and is not intended to represent the only aspects in which the present disclosure may be practiced. Each aspect described in this disclosure is provided merely as an example or illustration of the present disclosure, and should not necessarily be construed as preferred or advantageous over other aspects. The detailed description includes specific details for the purpose of providing a thorough understanding of the present disclosure. However, it will be apparent to those skilled in the art that the present disclosure may be practiced without these specific details. In some instances, well-known structures and devices are shown in block diagram form in order to avoid obscuring the concepts of the present disclosure. Acronyms and other descriptive terminology may be used merely for convenience and clarity and are not intended to limit the scope of the present disclosure.

Figure 1:
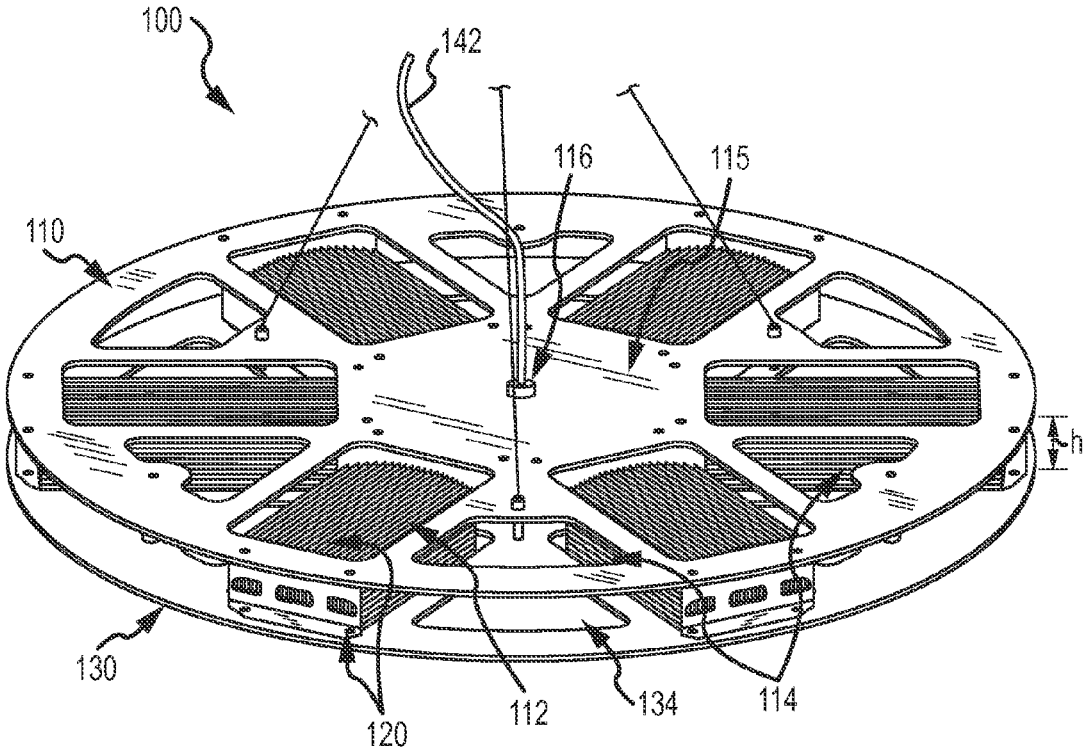
FIG. 1 illustrates an example of a modular LED space light.

FIG. 1 illustrates an example of a modular LED space light 100. In one aspect, the modular LED space light 100 includes a top plate 110, at least one module 120 and a bottom plate 130. The top plate 110 and the bottom plate 130 are spaced apart by an "h" dimension to receive one or more modules 120.

In one example, six modules 120 are mounted between the top plate 110 and the bottom plate 130. The six modules may be spaced apart from each other, for example, spaced evenly along a circular shape (e.g. at 60° angles) as illustrated in FIG. 1 to fit corresponding top plate openings 114 on top plate 110 and corresponding bottom plate openings 134 on bottom plate 130. In one example 28 LEDs are mounted on each module 120. In yet another example 36 LEDs are mounted on each module 120. It should be understood that the quantity of modules and LEDs in each module may vary to meet or match requirements of various applications or industries without affecting the scope and spirit of the present disclosure.

In one example, the "h" dimension is between 2 inches to 12 inches. One skilled in the art would understand that the "h" dimension illustrated herein is merely an example and that other dimensions are also within the scope and/or spirit of the present disclosure. In one example, the top plate 110 and the bottom plate 130 are fitted to each other by at least one or more of the following: a strut, a pin, a dowel or a rod, etc. One skilled in the art would understand that other structural components and methods of fitting the top plate 110 with the bottom plate 130 may be used and be within the scope and/or spirit of the present disclosure.

As illustrated in FIG. 1, the top plate 110 includes at least one top plate slot 112 positioned to align vertically to a respective module 120. And, the top plate 110 also includes at least one top plate opening 114 positioned to align vertically adjacent to a respective module 120. The bottom plate 130 includes at least one bottom plate slot 132 (see FIG. 3) positioned to align vertically to a respective module 120. And, the bottom plate 130 also includes at least one bottom plate opening 134 position to align vertically adjacent to a respective module 120.

Figure 2:
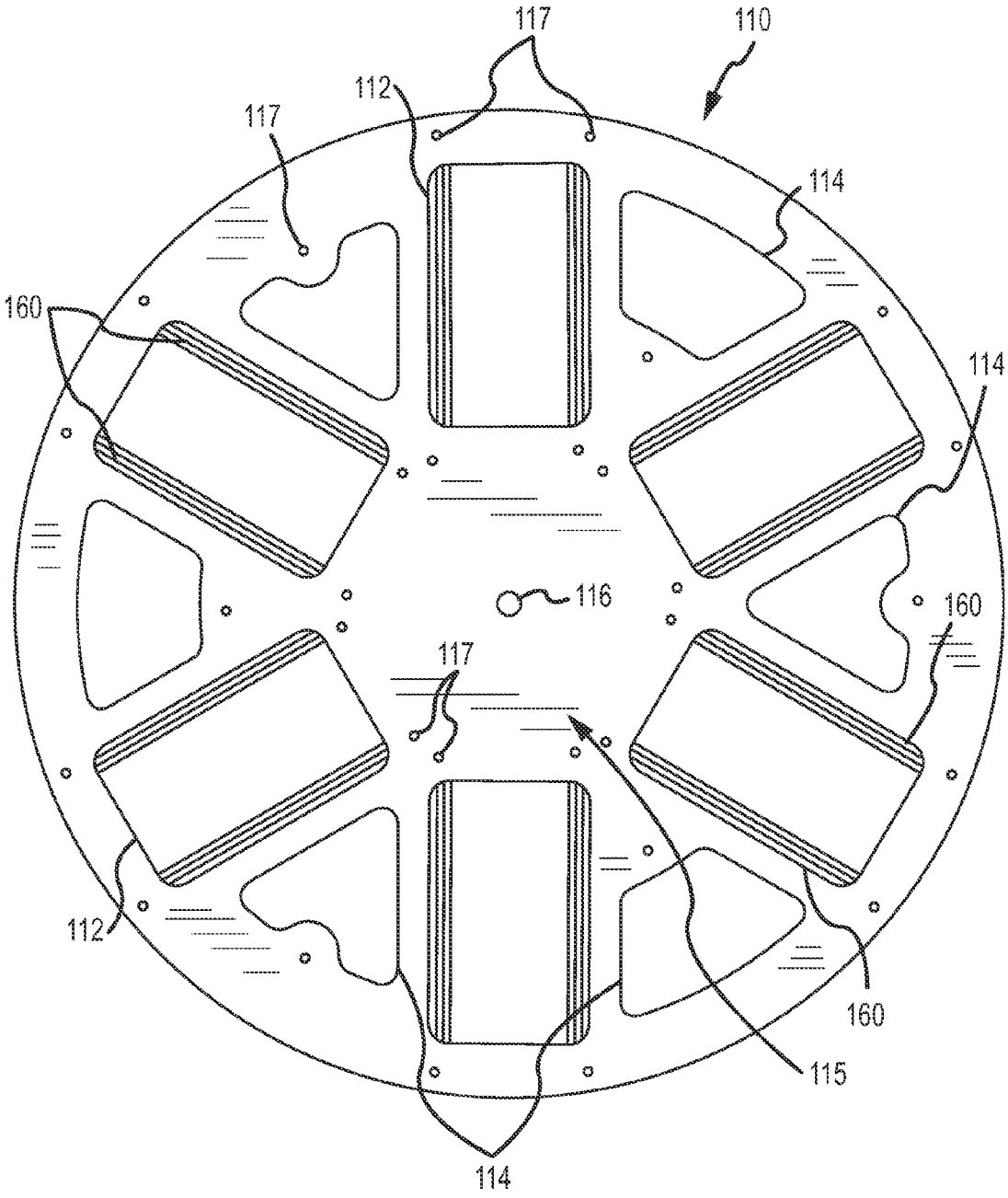
FIG. 2 illustrates an example of a top plate.

FIG. 2 illustrates an example of a top plate 110. In one example, the top plate 110 includes a top plate center portion 115. In one example, the top plate slot 112 is a rectangular shape which corresponds to a module 120 with a rectangular surface. In other examples, the module 120 may include surfaces of other shapes, such as but not limited to a square surface. As illustrated in FIG. 2, the top plate opening 114 may take on a variety of shapes, for example, a slightly triangular shape or a slightly trapezoidal shape. One skilled in the art would understand that the top plate slot 112 and the top plate opening 114 may take on other shapes without affecting the scope and/or spirit of the present disclosure. In one example, the top plate 110 includes one or more holes 117 for attaching one or more modules 120 and/or for attaching the top plate 110 to the bottom plate 130.

Figure 3:
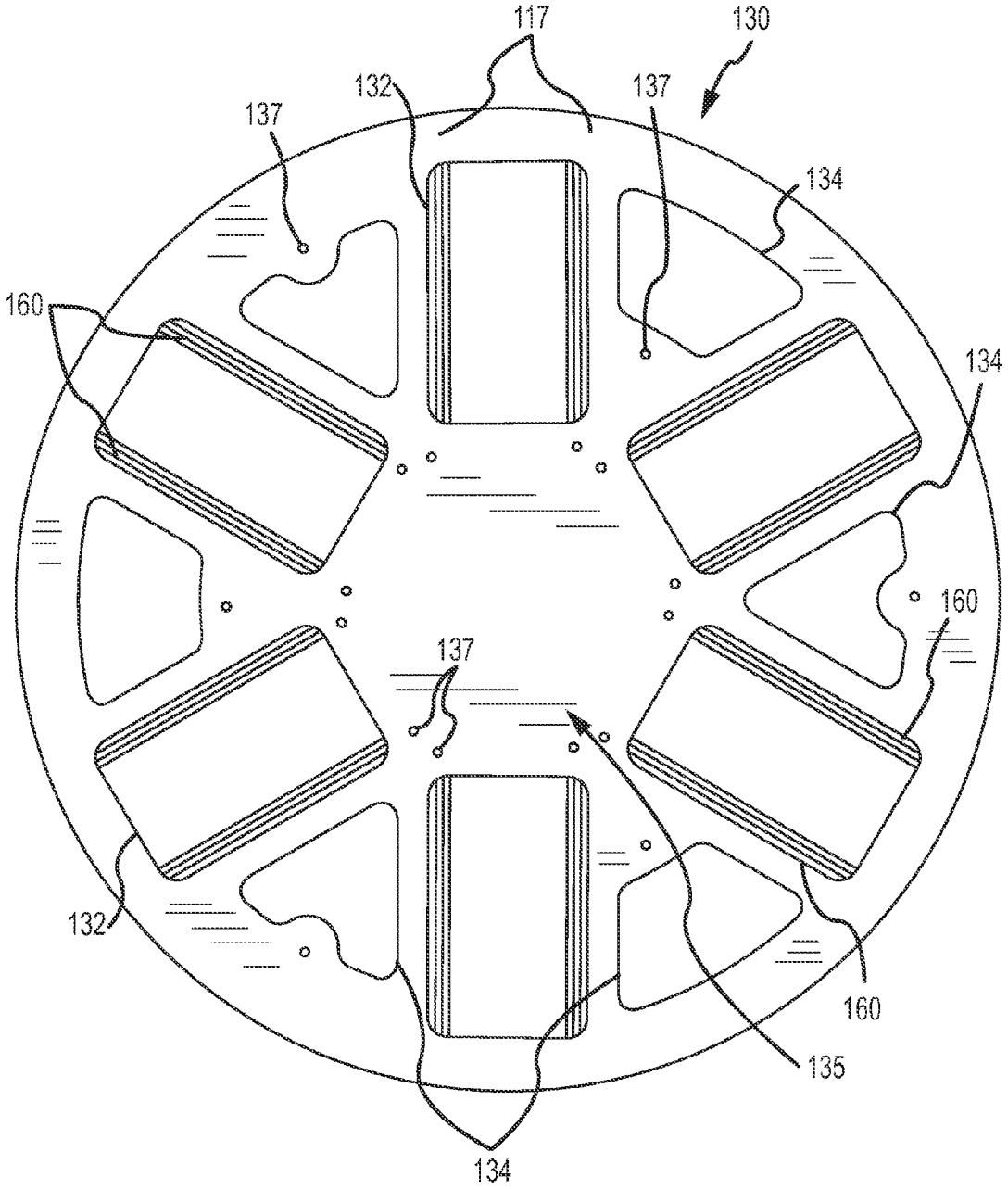
FIG. 3 illustrates an example of a bottom plate.

FIG. 3 illustrates an example of a bottom plate 130. In one example, the bottom plate 130 includes a bottom plate center portion 135. In one example, the bottom plate slot 132 is a rectangular shape which corresponds to a module 120 with a rectangular surface. As illustrated in FIG. 3, the bottom plate opening 134 may take on a variety of shapes, for example, a slightly triangular shape or a slightly trapezoidal shape. One skilled in the art would understand that the bottom plate slot 132 and the bottom plate opening 134 may take on other shapes without affecting the scope and/or spirit of the present disclosure.

In one example, the quantity of top plate openings 114 is the same as the quantity of bottom plate openings 134. And, each top plate opening 114 is vertically aligned with a corresponding bottom plate opening 134. By aligning the top plate openings 114 with the bottom plate openings 134, direct paths of air flow are created to improve heat flow of the LEDs. And, having improved heat flow may prolong the operating life of the LEDs. In yet one example, at least one top plate opening 114 is not aligned to a bottom plate opening 134.

In one example, a power supply 170 (not shown) may be housed within a cavity 171 (see FIGS. 8*b* and 9*b*) formed between the top plate center portion 115 and the bottom plate center portion 135. A power cord 142 (see FIG. 1) may be attached via a hole 116 (see FIG. 2) on the top plate center portion 115.

Although as illustrated in FIGS. 1-3, the top plate 110 and the bottom plate 130 are circular in shape, one skilled in the art would understand that other shapes (e.g., square, rectangular, triangular, trapezoidal, etc.) may also be used without affecting the scope and/or spirit of the present disclosure. In one aspect, a modular LED space light with circularly shape top plate 110 and bottom plate 130 allows multiple modules 120 to be arranged in a radial pattern for efficient heat flow.

In one example, the top plate 110 and/or the bottom plate 130 are made of Aluminum. However, the top plate 110 and/or the bottom plate 130 may be made of any ferrous material or any non-ferrous material. Some examples of suitable material may include but are not limited to composites such as carbon fiber, carbon nanotube, steel, stainless steel, steel alloys, plastic, thermal plastic, etc.

In one example, the top plate 110 or the bottom plate 130 is cut using a water jet laser to achieve high precision. However, one skilled in the art would understand that many cutting process may be used to achieve a top plate or a bottom plate to achieve the purposes and/or scope of the present disclosure. In one example, the bottom plate 130 includes one or more holes 137 for attaching one or more modules 120 and/or for attaching the bottom plate 130 to the top plate 110.

Figure 4A:
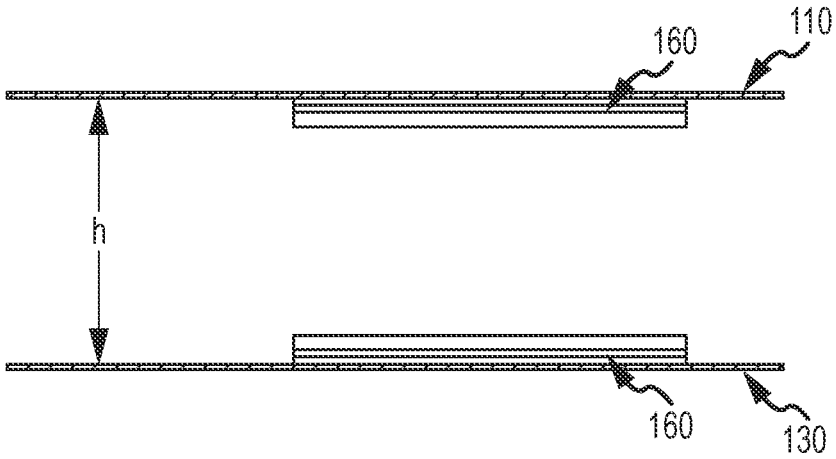
FIG. 4*a* illustrates an example side view of a top plate with a bottom plate.
Figure 4B:
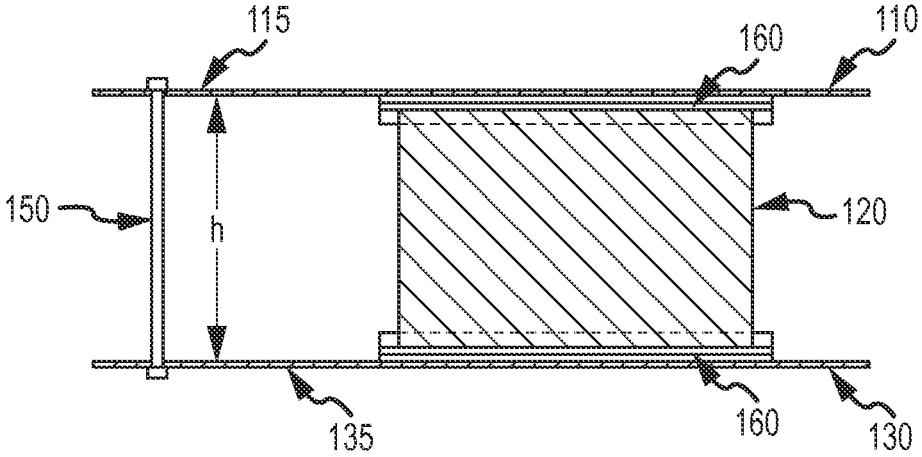
FIG. 4*b* illustrates an example side view of a top plate with a bottom plate and a module fitted between the top plate and the bottom plate.

FIG. 4*a* illustrates an example side view of a top plate with a bottom plate. The top plate 110 and the bottom plate 130 are fitted together such that they are spaced apart by an "h" dimension. In one example, the top plate 110 includes one or more grooves 160 and the bottom plate 130 includes one or more grooves 160. The grooves 160 allow a module 120 to slide in between the top plate 110 and the bottom plate 130 as illustrated in FIG. 4*b*.

In one example, where a module 120 fails to function appropriately and needs to be replaced, repaired or maintained, only the affected module needs to be removed from the modular LED space light 110. In this scenario, the affected module can slide out of the grooves 160 and another module can slide into the grooves 160 to take its place. That is, it is not necessary to remove or replace the entire space light when a module 120 fails to function appropriately or needs maintenance.

In one example, the top plate 110 and the bottom plate 130 are fitted to each other by at least one or more mechanism 150 which may be one of the following: a strut, a pin, a dowel or a rod, etc. Other examples of mechanism 150 not listed herein may be used without affecting the scope and spirit of the present disclosure.

Figure 5A:
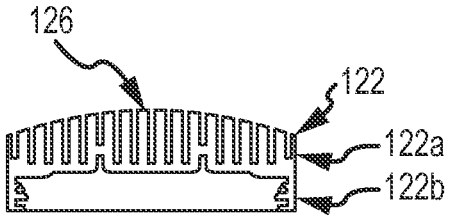
FIG. 5*a* illustrates an example front view of a module.

FIG. 5*a* illustrates an example front view of a module 120. In one aspect, the module 120 includes a front module plate 122, a plurality of light emitting diodes (LEDs) 128 (see FIG. 5*d*) mounted on at least one printed circuit board (PCB) 127*a*, 127*b*, 127*c* (see FIG. 5*d*). Housed within the module 120 is a passive heat sink 125 (not shown). And, in another example, one or more current control drivers 121 (not shown) for operating the LEDs 128 are also housed within the module 120. In one example, the front module plate 122 includes a top portion 122*a* and a bottom portion 122*b*. The top portion 122*a* includes ridges 126 for improved thermal propagation. In one aspect, the ridges 126 and the passive heat sink 125 (not shown) work in conjunction to improve thermal propagation.

In one aspect, each module 120 has its own passive heat sink 125. Because the modules 120 are spaced apart, the LEDS mounted on each module 120 have better ventilation, are kept cooler and therefore may prolong its operating life. In another aspect, a centralized passive heat sink is used for the modular LED space light 100. The centralized passive heat sink may be housed within the cavity 171 formed between the top plate center portion 115 and the bottom plate center portion 135. Or, if the modular LED space light 100 includes either a top housing 200 (see FIGS. 8*a* & 8*b*) or a bottom housing 300 (see FIGS. 9*a* & 9*b*), the centralized passive heat sink may be housed within it. In another example, heat pipes are also included for heat dissipation.

Figure 5B:
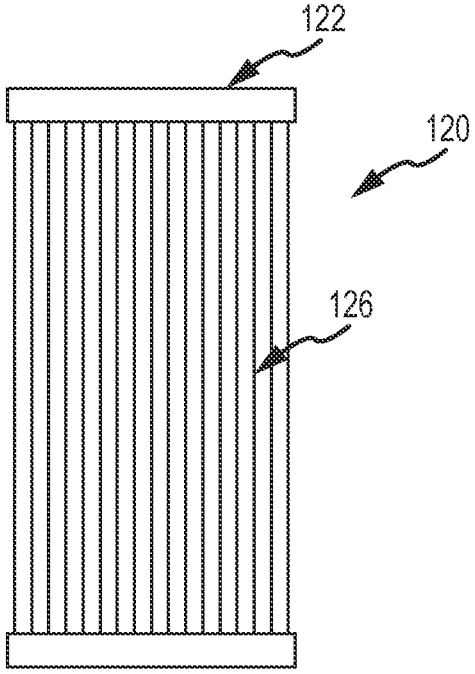
FIG. 5*b* illustrates an example top view of the module of FIG. 5*a*.
Figure 5C:
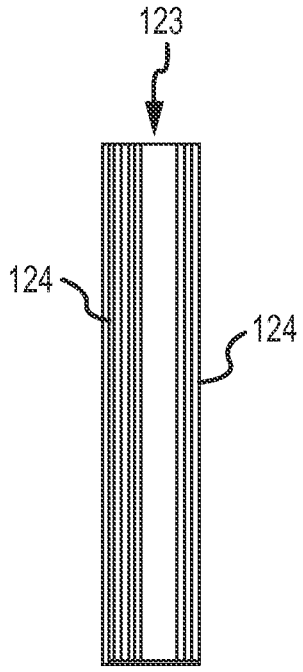
FIG. 5*c* illustrates an example side view of the module of FIG. 5*a*.

FIG. 5*b* illustrates an example top view of the module 120 of FIG. 5*a*. FIG. 5*c* illustrates an example side view of the module of FIG. 5*a*. As illustrated in FIG. 5*c*, the module includes a side plate 123 adapted to slide into one or more grooves 160 of either the top plate 110 or the bottom plate 130. In one example, the side plate 123 includes side plate grooves 124 to fit grooves 160 on the top plate 110 and the bottom plate 130 of the modular LED space light 100.

Figure 5D:
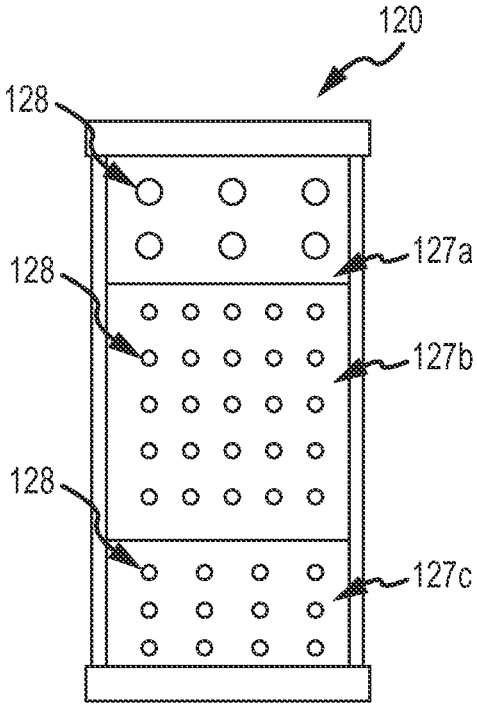
FIG. 5*d* illustrates an example bottom view of the module of FIG. 5*a*.

FIG. 5*d* illustrates an example bottom view of the module of FIG. 5*a*. As illustrated in the example of FIG. 5*d*, a plurality of LEDs 128 are mounted on three PCBs 127*a*, 127*b*, 127*c*. In one example, one or more of the three PCBs 127*a*, 127*b*, 127*c* are designed to slide in and out of the module 120. In another example, one or more of the three PCBs 127*a*, 127*b*, 127*c* are designed to attach to the module 120, for example, by clipping the PCB onto the module 120. In yet another example, the PCBs are part of the structures of the module 120. One skilled in the art would understand that the present disclosure is not limited to three PCBs and that other quantities of PCBs are within the scope and spirit of the present disclosure.

The quantity of LEDs 128 on each of the three PCBs 127*a*, 127*b*, 127*c* may be the same or may be different. In one example, a module 120 may include as few as one LED. In another example, a module 120 may include as many as 50 LEDs. In yet another example, a module 120 includes 28 LEDs mounted on one or two or three PCBs. In yet another example, a module 120 includes 36 LEDs mounted on one or two or three PCBs. The quantity of LEDs on one module may differ from the quantity of LEDs on another module in the same modular LED space light. And, the quantity of PCBs on one module may differ from the quantity of PCBs on another module in the same modular LED space light.

In one example, the LEDs 128 on each of the three PCBs 127*a*, 127*b*, 127*c* may be of different types or may be of the same types. An LED has an intrinsic color temperature. In one example, an LED type is categorized (a.k.a. LED bin) by its intrinsic color temperature. In another example, an LED type is categorized by the intensity or lumen output of the light emitted by the LED. In yet another example, an LED type is categorized by the directionality of the light emitted by the LED. In yet another example, an LED type is categorized by the spectral width (i.e., bandwidth) of the light emitted by the LED. In yet another example, an LED type is categorized by the coherence of the light emitted by the LED. In yet another example, an LED type is categorized by the power efficiency of the light emitted by the LED. One skilled in the art would understand that there are many examples of LED types and that the examples of LED types disclosed herein are not exclusive. Other LED types may be used without affecting the scope and spirit of the present disclosure.

Figure 6A:
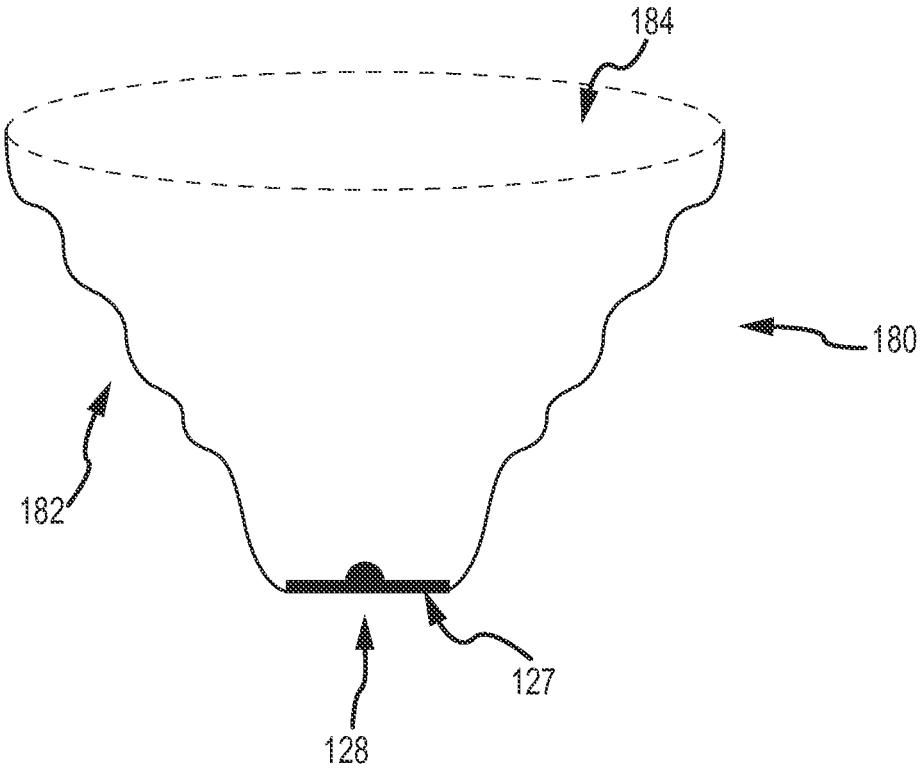
FIG. 6*a* illustrates an example of a light emitting diode (LED) mounted on a printed circuit board (PCB) with a reflector.
Figure 6B:
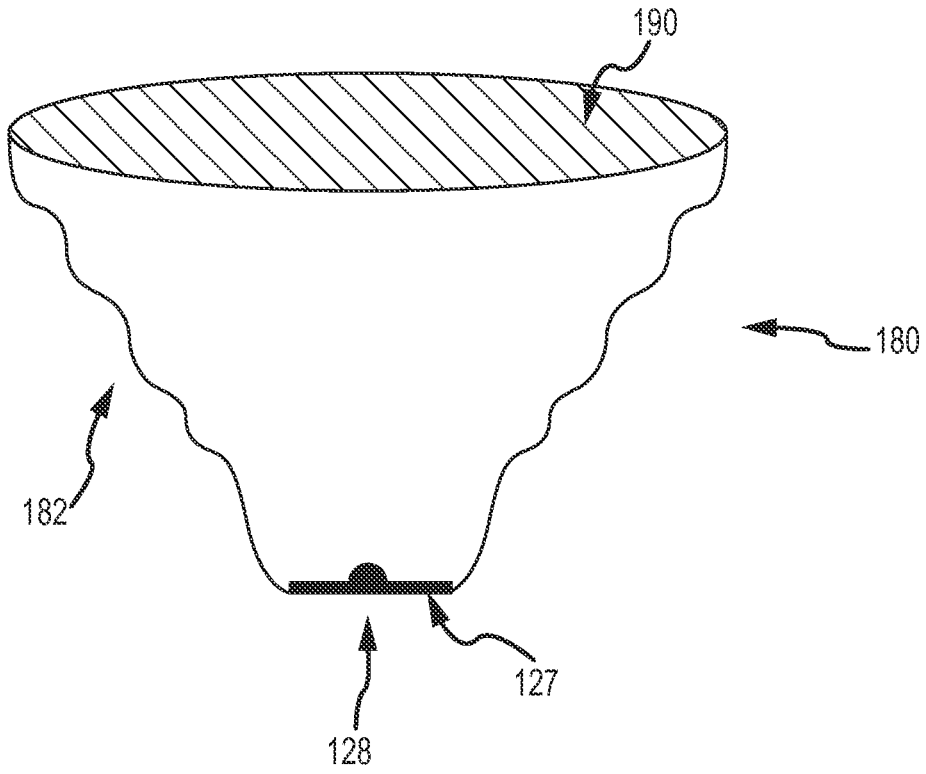
FIG. 6*b* illustrates an example of a diffuser covering an aperture of a reflector.

FIG. 6*a* illustrates an example of a light emitting diode (LED) mounted on a printed circuit board (PCB) with a reflector. In one aspect, one or more of the LEDs 128 are mounted on the PCB 127 with a reflector 180. The reflector 180 includes a reflector wall 182 and an aperture 184. In one example, the reflector wall 182 has a wavy contour for shaping the light emitted by the LED. FIG. 6*b* illustrates an example of a diffuser 190 covering the aperture 184 of the reflector 180. In some examples, the diffuser and/or reflector may be referred to as an "optic" or a secondary optic. In an example, a diffuser 190 is placed over the aperture 184 of the reflector 180. The diffuser 190 may cover the aperture 184 partially or entirely. The diffuser 190 functions as a secondary smoothing optical device for further shaping the light emitted by the LED.

In one aspect, the reflector wall 182 is coated to adjust the spectral properties of the reflector wall 182. As the spectral properties of the reflector wall 182 are adjusted (for example by coating), the observed color temperature of the light emitted by the LED is correspondingly adjusted. In one example the reflector wall 182 is coated by vapor deposition or spray deposition. One would understand that the reflector wall may be coated by other techniques without affecting the scope and spirit of the present disclosure.

Figure 7:
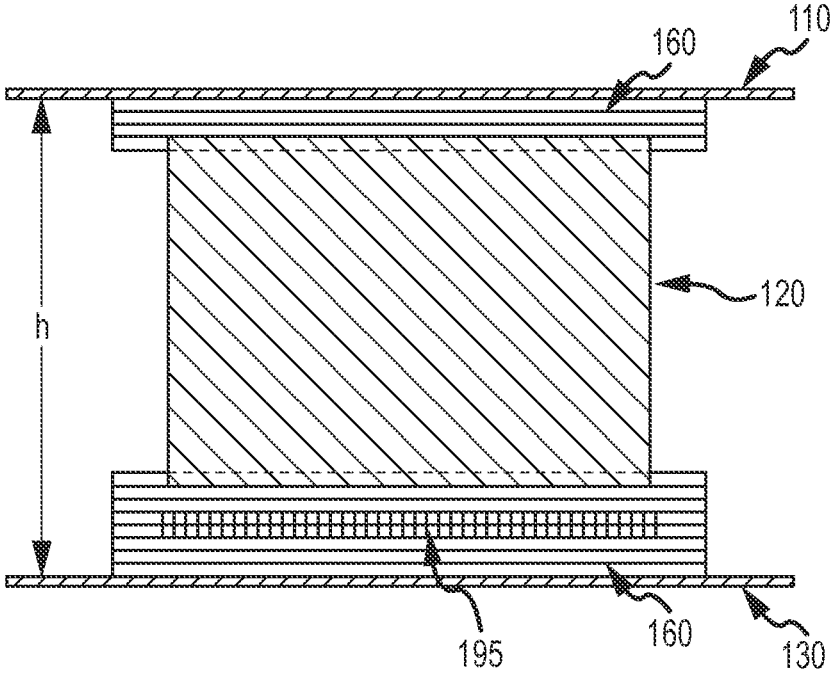
FIG. 7 illustrates a side view example of a top plate, a bottom plate with a module and a remote phosphor plate inserted in between the top plate and the bottom plate.

FIG. 7 illustrates a side view example of a top plate 110, a bottom plate 130 with a module 120 and a remote phosphor plate 195 inserted between the top plate 110 and the bottom plate 130. In one aspect, the LEDs 128 are mounted on the PCB 127 without a reflector and other optics. The remote phosphor plate 195 is inserted between the top plate 110 and the bottom plate 130 by sliding the remote phosphor plate 195 into the grooves 160. For example, the remote phosphor plate 195 slides into the grooves 160 of the bottom plate 130 as illustrated in FIG. 7. The remote phosphor plate 195 covers, partially or entirely, the plurality of LEDs 128 on the module 120.

The remote phosphor plate 195 modifies the intrinsic color temperature of the LEDs (e.g., blue die pump LEDs) to an observed color temperature to meet an illumination purpose. For example, the color of a group of LEDs is changed to a different color through the use of the remote phosphor plate 195. In another example, color tuning may be used to implement a desired observed color temperature.

In one aspect, one or more additional optic (such as but not limited to a diffuser, a reflector, a remote phosphor plate and/or an acrylic lens) may be used with the LED.

In one aspect, use of one or more of the disclosed combinations, including but not limited to, quantity of LEDs on a PCB, quantity of LEDs on a module, types of LEDs on a PCB, types of LEDs on a module, quantity of modules on a modular LED space light, one or more reflector mounted with the LEDs, one or more diffusers mounted with the LEDs, one or more remote phosphor plates used, and/or color tuning etc. allows for modifying the intrinsic color temperature of the LEDs to an observed color temperature to meet an illumination purpose.

In one example, the modular LED space light 100 includes a power cord 142 (see FIG. 1) for connecting into an electric source. In one example, the modular LED space light 100 may operate with as little as approximately 1.2 amps. This is a considerable current consumption savings when compared to a conventional space light that may draw approximately 50 amps. As a consequence of the current consumption savings, the modular LED space light 100 may use less and/or lighter external cabling and/or power feeds in order to energize the modular LED space light 100. Advantageously, because the modular LED space light 100 has minimal current consumption, multiple units, for example 12 units, may be connected to a single, standard household 15 amp receptacle.

Figure 8A:
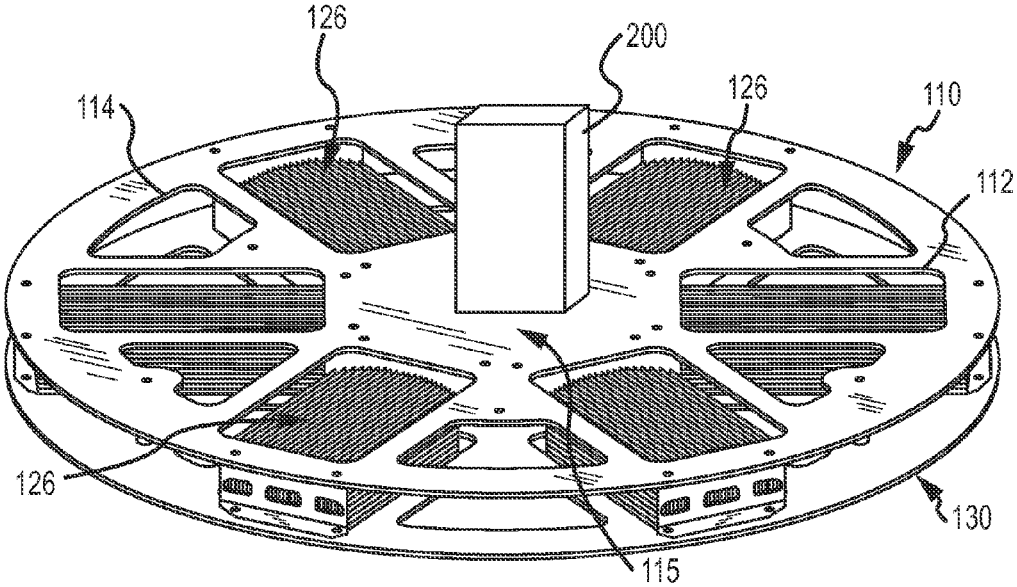
FIG. 8*a* illustrates a perspective view of an example modular LED space light with a top housing on its top plate.
Figure 8B:
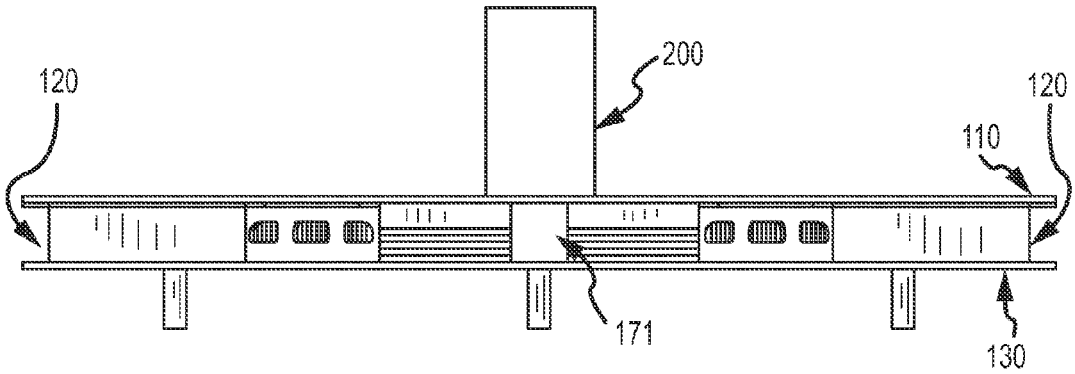
FIG. 8*b* illustrates a side view of the example modular LED space light of FIG. 8*a*.

FIG. 8*a* illustrates a perspective view of an example modular LED space light 100 with a top housing 200 on its top plate 110. FIG. 8*b* illustrates a side view of the example modular LED space light of FIG. 8*a*. In one example, the top housing 200 is placed on top of the top plate center portion 115. The top housing 200 may house one or more battery units to act as direct current (DC) sources for the modular LED space light 100 as an alternative to connect to an alternate current (AC) source. In one example, the top housing 200 houses one or more electronic units (e.g., a transceiver, etc.) for turning the modular LED space light 100 ON or OFF, for dimming the LED light output, for performing diagnostics (i.e., troubleshooting), or for programming custom light scenes (e.g., chases) on one or more of the modules 120. The one or more electronic units may operate via wired or wireless communication technology (e.g., DMX (Digital Multiplex), DMX512 (Digital Multiplex with 512 pieces of information), RG-45 such as CATS and/or Ethernet connections, Bluetooth and network connections, Multiple Input Multiple Output (MIMO) technology, multiple access technologies, such as but not limited to, code division multiple access (CDMA) systems, time division multiple access (TDMA) systems, frequency division multiple access (FDMA) systems, orthogonal frequency division multiple access (OFDMA) systems, single-carrier frequency divisional multiple access (SC-FDMA) systems, and time division synchronous code division multiple access (TD-SCDMA) systems, etc.). In the wired configuration, the electronic units may be daisy chained to one another. In another example, the top housing 200 may house one or more redundant power supplies. One skilled in the art would understand that electronic units with other functions not mentioned herein may be housed within the top housing 200 without violating the scope and spirit of the present disclosure.

Figure 9A:
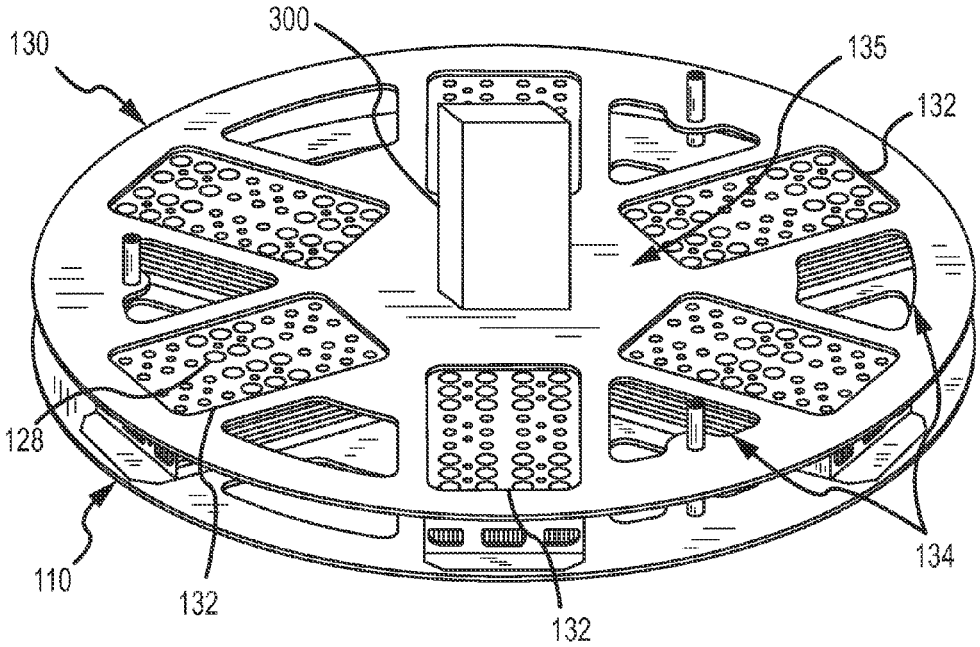
FIG. 9*a* illustrates a perspective view of an example modular LED space light with a bottom housing on its bottom plate.
Figure 9B:
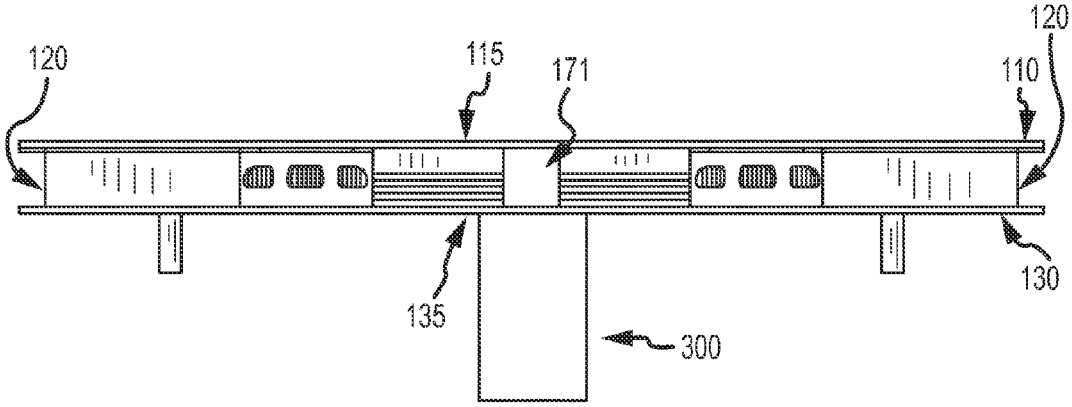
FIG. 9*b* illustrates a side view of the example modular LED space light of FIG. 9*a*.

FIG. 9*a* illustrates a perspective view of an example modular LED space light 100 with a bottom housing 300 on its bottom plate 130. FIG. 9*b* illustrates a side view of the example modular LED space light of FIG. 9*a*. In one example, the bottom housing 300 is placed on bottom of the bottom plate center portion 135. The bottom housing 300 may house one or more battery units to act as direct current (DC) sources for the modular LED space light 100 as an alternative to connecting to an alternating current (AC) source. In one example, the bottom housing 300 houses one or more electronic units (e.g., a transceiver, etc.) for turning the modular LED space light 100 ON or OFF, or for dimming the LED light output on one or more of the modules 120. The one or more electronic units may operate via wired or wireless communication technology (e.g., DMX, RG-45). In another example, the bottom housing 300 may house one or more redundant power supplies. One skilled in the art would understand that electronic units with other functions not mentioned herein may be housed within the bottom housing 300 without violating the scope and spirit of the present disclosure.

In one example, the modular LED space light 100 uses classic dimensions (e.g., dimensions that have been historically used in the entertainment industry). As such, the modular LED space light 100 may fit existing space light accessories in the industry. Examples of accessories used with the modular LED space light 100 include silk skirts attached to the top plate 110 of the modular LED space light 100 to soften light illumination, and/or solid skirts attached to the top plate 110 to block light in certain directions (e.g., side directions). In one example, a target is placed below the silk or solid skirt attached to the modular LED space light 100 to block light illumination or diffuse light illumination. The silk skirts and/or solid skirts may also be attached to the bottom plate 130. And, examples of accessories may include standard transport carts for carrying the modular LED space light 100. The accessories listed are only examples and there are other accessories not listed herein which the modular LED space light 100 may accommodate without the need for modification to either the modular LED space light 100 and/or the accessory.

Figure 10:
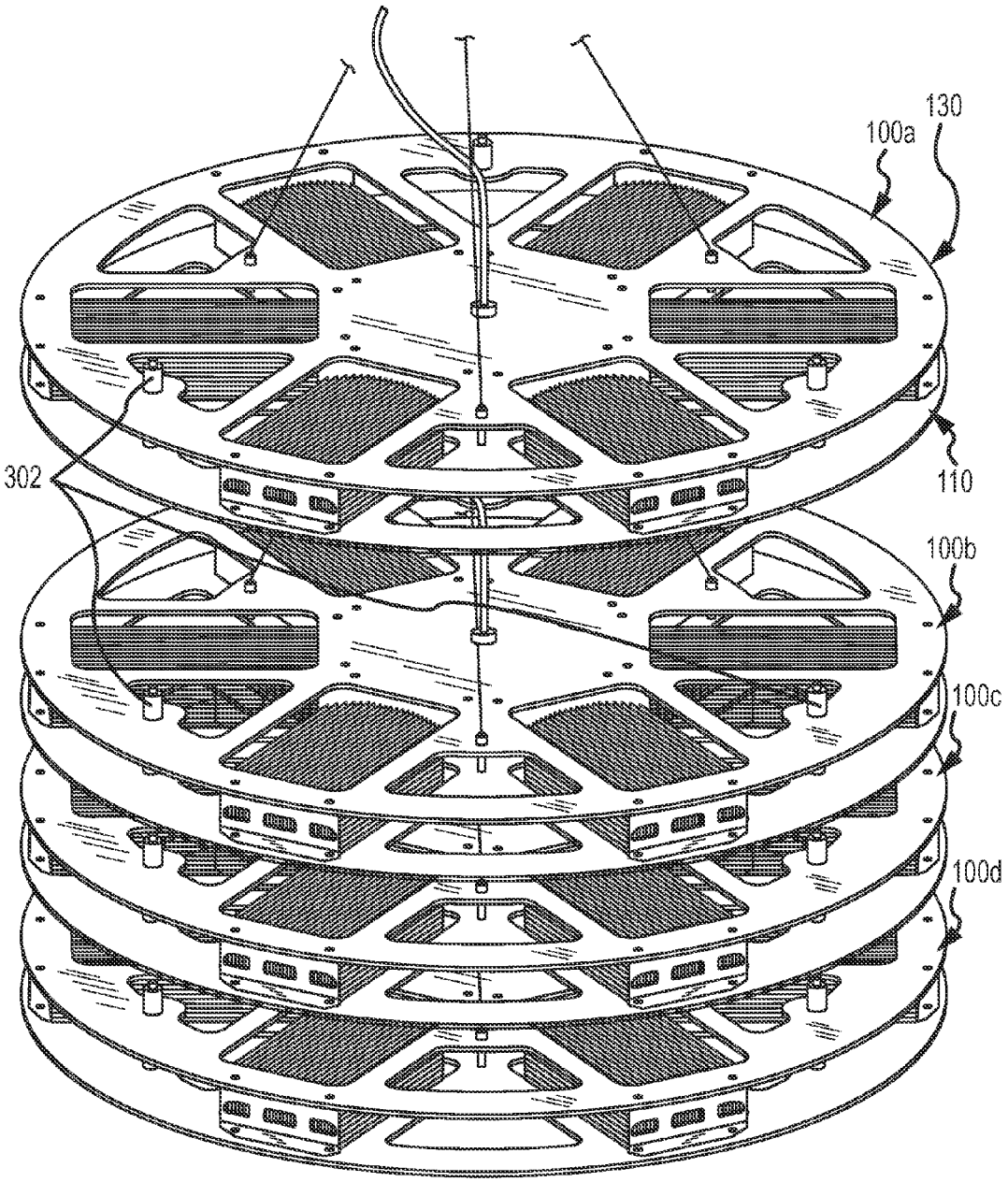
FIG. 10 illustrates an example of a plurality of stackable modular LED space lights.

FIG. 10 illustrates an example of a plurality of stackable modular LED space lights. In FIG. 10, the bottom plates 130 of each of the stackable modular LED space lights 100*a*, 100*b*, 100*c*, 100*d* are shown on top while the top plates 110 are shown on the bottom. In one example, a first stackable modular LED space light 100*a* includes at least one protrusion 302 on bottom plate 130 positioned to fit into a receiving notch 202 (not shown) on the top plate 110 of a second stackable modular LED space light 100*b* as illustrated in FIG. 10. In one example, the receiving notch 202 is a hole on the top plate 110 for receiving the protrusion 302. In another example, the receiving notch 202 is a nut that fits the protrusion 302. One skilled in the art would understand that other example mechanisms may function as a receiving notch without affecting the scope and spirit of the present disclosure.

Four stackable modular LED space lights 100*a*, 100*b*, 100*c*, 100*d* are illustrated in FIG. 10 as an example. One skilled in the art would understand that the quantity of modular LED space lights being stacked vertically onto each other may increase or decrease from the example of four stackable modular LED space lights.

In one example, the modular LED space light 100 as disclosed herein may offer approximately 150,000 hours of operating life, which is equivalent to leaving a light on for 24 hours a day for approximately 17 years. Having a long operating life reduces the need for replacements and thus allows for cost savings.

In one example, the modular LED space light 100 may weigh approximately 40.5 pounds as compared to conventional LED space lights which are much heavier, for example, weighing approximately 70 lbs.

In one example, the modular LED space light 100 may weigh approximately 40.5 pounds.

The modular LED space light 100 may be used in a variety of lighting applications, for example, in the entertainment industry such as for lighting in special events, films, television and/or theatre sets, movie studio sets and/or productions.

One skilled in the art would further appreciate that the various illustrative components, logical blocks, modules, circuits, and/or algorithm steps described in connection with the examples disclosed herein may be implemented as electronic hardware, firmware, computer software, applications (including specialized programs for downloading onto mobile devices) or combinations thereof. To clearly illustrate this interchangeability of hardware, firmware and software, various illustrative components, blocks, modules, circuits, and/or algorithm steps have been described above generally in terms of their functionality. Whether such functionality is implemented as hardware, firmware or software depends upon the particular application and design constraints imposed on the overall system. Skilled artisans may implement the described functionality in varying ways for each particular application, but such implementation decisions should not be interpreted as causing a departure from the scope or spirit of the present disclosure.

Additionally, any illustrative flow diagrams, logical blocks, modules and/or algorithm steps described herein may also be coded as computer-readable instructions carried on any computer-readable medium known in the art or implemented in any computer program product known in the art. In one aspect, the computer-readable medium includes non-transitory computer-readable medium.

Computer-readable media includes both computer storage media and communication media including any medium that facilitates transfer of a computer program from one place to another. A storage media may be any available media that may be accessed by a computer. By way of example, and not limitation, such computer-readable media may include RAM, ROM, EEPROM, CD-ROM, DVD or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies, such as but not limited to, DMX, DMX512, RG-45, infrared, radio, microwave, and multiple access technologies then the coaxial cable, fiber optic cable, twisted pair, DSL, or wireless technologies, such as but not limited to, infrared, radio, microwave and multiple access technologies are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media.

The previous description of the disclosed aspects is provided to enable any person skilled in the art to make or use the present disclosure. Various modifications to these aspects will be readily apparent to those skilled in the art, and the generic principles defined herein may be applied to other aspects without departing from the spirit or scope of the disclosure.

The invention claimed is:

1. A modular light emitting diode (LED) space light comprising:

a top plate including a top plate slot and at least one top plate groove;

a bottom plate including a bottom plate slot and at least one bottom plate groove;

at least one module having at least one light emitting diode (LED), wherein the at least one module is adapted to fit between the top plate and the bottom plate correspondingly in the top plate slot and the bottom plate slot;

a plurality of grooves on the at least one module adapted to slidably fit in an offset position to the at least one top plate groove or the at least one bottom plate groove; and at least one passive heat sink coupled to the at least one module to dissipate heat generated by the at least one LED.

2. The modular LED space light of claim 1, wherein one of the at least one passive heat sink is housed within one of the at least one module.

3. The modular LED space light of claim 1, wherein the top plate further includes a top plate opening and the bottom plate further includes a bottom plate opening, and wherein the top plate opening is vertically aligned with the bottom plate opening.

4. The modular LED space light of claim 3, wherein the top plate opening is adjacent to the top plate slot.

5. The modular LED space light of claim 1, wherein the at least one module comprises at least one printed circuit board (PCB) and the at least one LED is mounted on the at least one PCB.

6. The modular LED space light of claim 5, wherein the at least one module comprises a current control driver for operating the at least one LED.

7. The modular LED space light of claim 5, wherein the at least one LED is mounted with a reflector on the at least one PCB.

8. The modular LED space light of claim 7, wherein the reflector comprises a reflector wall and an aperture, and the reflector wall includes a wavy contour for shaping the light emitted by the at least one LED.

9. The modular LED space light of claim 8, further comprising a diffuser inserted over the aperture.

10. The modular LED space light of claim 1 further comprising a remote phosphor plate covering at least partially over the at least one LED.

11. The modular LED space light of claim 10, wherein the remote phosphor plate is inserted into at least one groove associated with the bottom plate for covering at least partially over the at least one LED.

12. The modular LED space light of claim 1, further comprising a top housing mounted to a top plate center portion of the top plate, wherein the top housing houses one or more of the following: a passive heat sink, a battery unit, a transceiver or a control driver.

13. The modular LED space light of claim 1, further comprising a bottom housing mounted to a bottom plate center portion of the bottom plate, wherein the bottom housing houses one or more of the following: a passive heat sink, a battery unit, a transceiver or a control driver.

14. The modular LED space light of claim 1, wherein the top plate and the bottom plate are circular.

15. The modular LED space light of claim 14, further comprising at least one protrusion on the bottom plate positioned to fit into a receiving notch on a second top plate of a second modular LED space light.

16. A modular light emitting diode (LED) space light comprising:

a top plate including at least six top plate slots and a plurality of top plate grooves;

a bottom plate including at least six bottom plate slots and a plurality of bottom plate grooves;

at least six modules with each module having at least one light emitting diode (LED), wherein each of the at least six modules is adapted to fit between the top plate and the bottom plate correspondingly in one of the at least six top plate slots and in one of the at least six bottom plate slots in a radial pattern;

at least six sets of plurality of grooves with each set corresponding to each of the at least six modules, wherein each set of plurality of grooves is adapted to slidably fit in an offset position to at least one of the plurality of top plate grooves or at least one of the plurality of bottom plate grooves;

and at least six passive heat sinks with one of the at least six passive heat sinks coupled to one of the at least six modules to dissipate heat generated by the at least one LED mounted on the one of the at least six modules.

17. The modular LED space light of claim 16, wherein the top plate further includes at least six top plate openings and the bottom plate further includes at least six bottom plate openings, and wherein one of the at least six top plate openings is vertically aligned with one of the at least six bottom plate openings.

18. The modular LED space light of claim 17, wherein one of the at least six top plate openings is adjacent to one of the at least six top plate slots.

19. The modular LED space light of claim 16, wherein one of the at least six modules comprises at least three printed circuit boards (PCBs) and each of the at least three PCBs having an LED mounted thereon.

20. The modular LED space light of claim 19, further comprising a reflector mounted on one of the at least three PCBs.

21. The modular LED space light of claim 20, wherein the reflector comprises a reflector wall and an aperture, and the reflector wall includes a wavy contour for shaping the light emitted by the LED.

22. The modular LED space light of claim 21, further comprising a diffuser placed over the aperture of the reflector.

23. The modular LED space light of claim 16, further comprising a remote phosphor plate to at least partially cover the at least one LED on one of the at least six modules.

24. The modular LED space light of claim 16, wherein each of the at least six modules comprises at least 28 LEDs mounted on at least one printed circuit board (PCB).

25. The modular LED space light of claim 16, wherein each of the at least six modules comprises at least 36 LEDs mounted on at least one printed circuit board (PCB).

26. The modular LED space light of claim 16, wherein the top plate and the bottom plate are circular.

27. The modular LED space light of claim 26, further comprising at least one protrusion on the bottom plate positioned to fit into a receiving notch on a second top plate of a second modular LED space light.

* * * * *